United States Patent [19]

Gassner et al.

[11] Patent Number: 4,794,979

[45] Date of Patent: Jan. 3, 1989

[54] METHOD FOR MELTING METAL, PARTICULARLY SCRAP, AND FORMING METAL BILLETS

[75] Inventors: Robert H. Gassner, Fullerton; John J. Shaw, Westminster, both of Calif.

[73] Assignee: McDonnell Douglas Corporation, Long Beach, Calif.

[21] Appl. No.: 620,959

[22] Filed: Jun. 15, 1984

[51] Int. Cl.[4] ..... B22D 27/02

[52] U.S. Cl. ..... 164/495; 164/469; 164/66.1

[58] Field of Search ..... 164/469, 470, 495–497, 164/508, 509, 514, 519, 66.1

[56] References Cited

U.S. PATENT DOCUMENTS 2,881,489 4/1959 Mullaney et al. ..... 75/10 R X 3,820,586 6/1974 Takei ..... 164/506

*Primary Examiner*—Kuang Y. Lin

*Attorney, Agent, or Firm*—Max Geldin

[57] ABSTRACT

The process for producing a metal billet or slab which is substantially homogeneous, fine grained and free of freezing or chemical segregation, which comprises fusing the metal, e.g. titanium or a titanium alloy, by an intense heat source, e.g. a plasma torch, to provide a small molten pool of metal within a charge of the metal, which can be scrap metal such as scrap titanium or a mixture of titanium alloy scrap, master alloy and titanium sponge. The charge of metal, preferably contained in a mold car, is traversed in a substantially horizontal plane with respect to the heat source, thereby causing the small molten pool of metal to also traverse within the metal charge, and continually melting fresh charge metal adjacent to its leading edge and causing rapid freezing of the metal adjacent to the trailing edge of the small molten pool of metal as the melted charge moves away from the heat source.

26 Claims, 2 Drawing Sheets

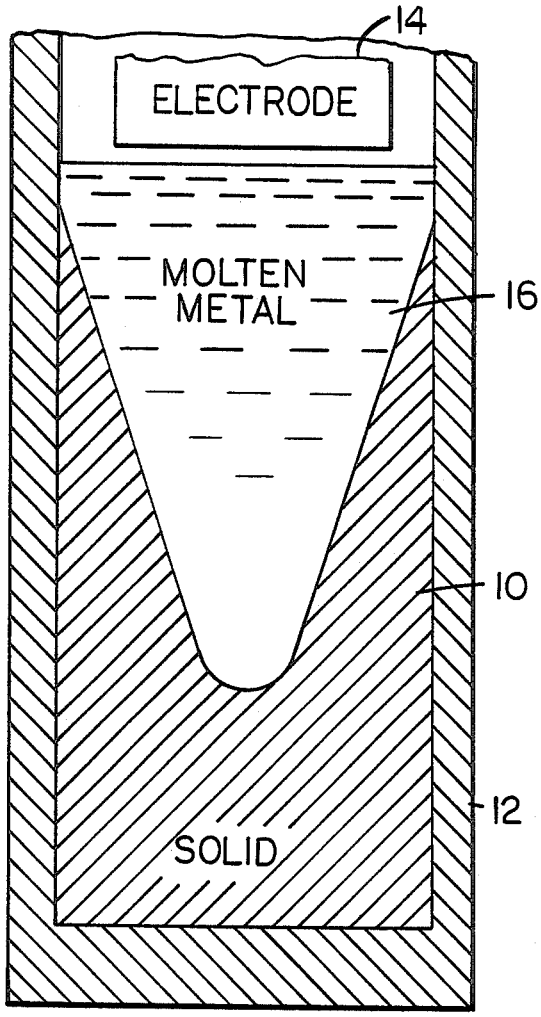
FIG. 1
(PRIOR ART)
FIG. 2
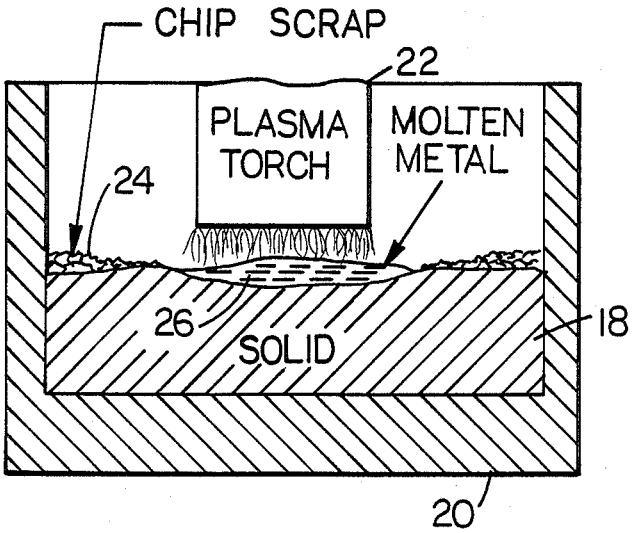

METHOD FOR MELTING METAL, PARTICULARLY SCRAP, AND FORMING METAL BILLETS

BACKGROUND OF THE INVENTION

This invention relates to production of metal products, such as billets or slabs, and is particularly directed to a novel process for fusing metals, particularly but not exclusively, reactive metals such as titanium, zirconium, and alloys thereof, and especially in the form of scrap and/or sponge metal, and solidifying such metals under conditions to produce a metal billet or slab which is chemically homogeneous, fine grained and free of freezing segregation Conventionally, wrought metal products are made by breaking down cast ingots through a variety of hot working processes (forging rolling, extrusion) and/or cold working plus annealing to a desired final size and shape. Economic considerations, primarily minimizing scrap losses due to surface defects and trimming during breakdown, dictate casting ingots as large as possible. Unfortunately the resultant slow solidification leads to chemical segregation and large grain size. Consequently, many of the procedures used for ingot breakdown to final product are aimed at mitigating these deficiencies; however, they are not usually completely successful, and current mill products frequently incorporate chemical inhomogeities together with larger than optimum grain size.

The deficiencies of conventional practices are responsible for a significant portion of product costs, degradation of part fabrication characteristics and lowering of design allowables. The energy and capital equipment costs for breaking down large ingots are substantial. Other disadvantages of conventional practice include the cost of remelting large chunks of mill scrap, the metal lost as oxidized particles during removal of surface defects by grinding, and a second melt employed to improve ingot surface quality and reduce chemical inhomogeneities originating from raw material.

Additionally, part fabrication costs are detrimentally affected by large grain size and segregation. They lead to high rejection scrap rates in forming and forging operations and in magnetic inspection of high strength low alloy and stainless steel parts. Attempts to alleviate these effects, e.g., by reducing the rate of superplastic forming, usually only provide a slightly lower cost solution.

These efficiencies also detrimentally affect performance in service and therefore they inhibit design allowables. Among the properties reduced are strength, ductility, fracture toughness and stress corrosin resistance, and increase in fatigue crack propagation. These disadvantages could be substantially alleviated if current materials were finer grained and freer from segregation.

At present, approximately 25% of all titantium produced as ingots ends up as light fabrication scrap (chips, sheet trimmings, tube trimmings) which is not recycled. This material finds its way into the steel and aluminum industries at a price of a few cents per pound. It is not practical to consolidate such scrap in a non-consumable arc melting furnace because of the concentrated heat source. It is somewhat practical to consolidate it by electron beam melting, but the high vacuum depletes some of the alloying elements which must be replaced in subsequent double consumable melting. It is also somewhat practical to blend about 30% light scrap with sponge and master alloys, and produce conventional electrodes by compacting and welding; these must then be double consumable melted to obtain usable ingots.

Normally, titanium is double melted to homogenize the composition and improve the ingot surface. However, the deep molten pool resulting from the high melting rate used during the second melting for ingot surface improvement leads to segragation during freezing. Also, practicality requires very differnt melting and freezing rates at the bottom, center and top of the ingot. Therefore, inhomogeneity from surface to core and from top to bottom results.

Methods and apparatus for the melting and casting of metals such as titanium, and for scrap metal treatment, e.g. titanium scrap, and their recovery, are illustrated by U.S. Pat. Nos. 3,771,585; 3,417,808; 3,660,074; 3,385,494; and 3,843,352.

One object of the present invention is the provision of a process for melting and then freezing or solidifying a metal, e.g. titanium, to produce a billet or slab which is homogeneous and free of segregation.

Another object is to provide procedure for melting and then freezing or solidifying a metal, e.g. titanium, to produce a billet or slab having fine grain.

Still another object is the provision of a process for melting and then freezing or solidifying a metal, using metal scrap and/or metal sponge, particularly titanium, to produce a billet or slab which is homogeneous and free of freezing segregation, and having fine grain.

Other objects and advantages of the invention will appear hereinafter.

SUMMARY OF THE INVENTION

The concept of the present invention resides in the utilization of an intense local heat source and creating a small localized travelling molten pool of metal of rapidly freezing or solidifying the localized molten pool of metal during its continuous travel along the billet or slab. The rapid cooling of the successive localized molten pools of metal eliminates freezing segregation, that is, chemical segregation, during solidification, and also results in fine grain. The billet or slab resulting from such continuous, integrated fusing and welding of the small travelling molten pools, is homogeneous and requires a minimum of hot working, if any, for grain refinement.

In typically carrying out the process for producing a billet or slab of a metal, such as titanium, the charge, in the form of solid metal, scrap metal or metal sponge, is subjected to an intense local heat source, such as a plasma torch, to provide a localized, preferably small, molten pool of metal within a mold, such as a large water cooled cooper mold. The mold and the metal charge therein are continuously moved in a substantially horizontal plane beneath the heat source at a speed which maintains the small size of the pool as by forming fresh molten metal in the front of the heat source to balance that solidifying at the rear thereof, thereby in effect forming travelling molten pool of metal, due to the relative motion of the heat source and the molten pool with respect to the mold and the charge or partially complete billet or slab.

As the molten pool of metal travels along the upper surface of the charge from a first area to an adjacent area thereof under the heat source, the molten pool present in the first area rapidly cools, precluding freezing segregation and forming a solid homogeneous chemical composition. The rapid or substantially instantaneous freezing of the shallow molten pool of metal results in a solid metal billet or slab of fine grain.

Thus, the continuous, integrated casting and welding together of the small increments formed successively from the travelling molten pool of metal, produces a billet or slab of a metal, which is substantially homogeneous, fine grained and free of freezing or chemical segregation.

The process of the invention is particularly, but not necessarily, adapted to the melting and recovery of scrap metal, e.g., titanium scrap, by feeding the scrap metal or a mixture of scrap metal, master alloy, and virgin metal such as metal sponge into a water-cooled copper mold. According to a preferred embodiment, a homogeneous blend of titanium alloy scrap, master alloy, i.e. an alloy rich in the alloying constituents of the titanium alloy, such as an aluminum-vanadium alloy, and titanium sponge, is charged into a long water-cooled copper mold in an argon-filled furnace. A plasma torch is impinged on the charge at one end of the mold to form a shallow molten pool of titanium alloy and then the mold is moved gradually until the molten pool has traversed its full length. The continuous melting and freezing of the charge and the shallow molten pool formed produces rapid, incremental solidification as the molten pool travels horizontally beneath the torch. If desired, several charges and horizontal passes of the mold can be effected, each charge layer being subjected to the plasma torch and causing welding of such layer to the previous layer as the molten pool successively passes along the longitudinal axis of the mold.

The product of such melting, charcterized by the moving small molten pool of metal and its continuous solidification in multiple layers, can be considered to be analogous in form to a large multi-pass weld bead or a weldment consisting of many small ingots welded together. Its shape can be varied by varying the shape of the mold, e.g., from a square billet for forging to flat slab for sheet and plate rolling.

As noted above, in conventional practice titanium is double melted from compacted electrodes to homogenize the composition and improve the ingot surface. The present process avoids the cost of compacting, welding and one melting operation. Further, unlike conventionl processes which produce only round ingots, the shape produced by the the present process can be tailored to resemble the shape of the final product, e.g. slab for plate and sheet. Consequently, much of the energy and scrap costs associated with conventional breakdown can be avoided.

Accordingly, in its broad aspects, the present invention is directed to the process for producing a metal billet or slab, which is substantially homogeneous, fine grained and free of freezing segregation, which comprises fusing said metal by an intense local heat source to provide a localized molten pool of metal within a mold, and traversing said mold substantially horizontally with respect to said heat source, while maintaining said localized molten pool of metal within said mold adjacent to said local heat source, whereby freezing of said localized molten pool of metal occurs rapidly as the mold traverses with respect to said heat source.

In a preferred embodiment the metal being fused is scrap metal, particularly scrap titanium alloy, or a homogeneous blend of scrap titanium alloy and titanium sponge, and preferably also master alloy. Light scrap in the form of machining chips, sheet and tube traimmings, is particularly economical to use. It can be readily melted by an argon plasma torch in an argon atmosphere and solidified in a water cooled copper mold.

Thus, the intense heat source provided by the plasma torch fuses the metal to provide a small molten pool of metal within a charge of the metal, and the charge of metal is traversed with respect to the heat source, thereby causing the small molten pool of metal to also traverse within the metal charge, continually melting fresh charge metal adjacent to its leading edge and causing rapid freezing of the metal adjacent to the trailing edge of the small molten pool of metal as the melted charge moves away from the heat source.

Homogenization of the composition is assured by thorough mixing and blending of the scrap before melting; it is further enhanced by the diffusion which takes place during melting. The quality of the product will eliminate the need for hot working above the beta transus, i.e. above the 1800° F. in the case of 6A1-4V titanium alloy.

The above, together with other objects, features and advantages of the present invention, will become apparent to those skilled in the art from the following detailed description and the attached drawings, which, by way of example, illustrate only the preferred embodiments of the invention.

BRIEF DESCRIPTION OF THE DRAWINGS

FIG. 1 is a schematic elevational view showing formation of a conventional metal ingot;

FIG. 2 is a schematic view in elevation illustrating formation of a small, shallow molten pool of metal on the solid body of metal, according to the invention;

DETAILED DESCRIPTION OF THE INVENTION

Figure 3:
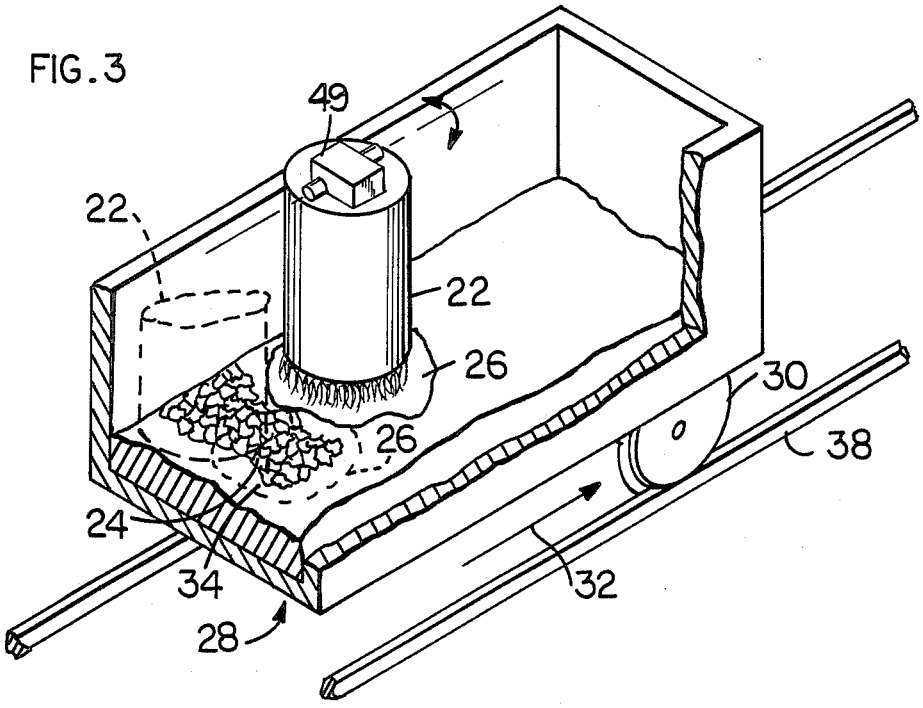
FIG. 3 is a perspective view, partly broken away, illustrating formation of a shallow molten pool of metal on a solid body of metal contained in a mold car, which can be moved relative to the plasma torch to provide a travelling molten pool of metal which solidifies as it moves away from the plasma torch.

Referring to FIG. 1 of the drawing, showing formation of a conventional ingot according to the prior art, the body of metal 10 contained in a water-cooled copper crucible 12 is formed from metal transferred across the arc between the conventional electrode 14 and the molten metal. The heating of the body of metal 10 by the arc forms a deep vertically disposed pool of molten metal 16.

As melting proceeds and the electrode is gradually withdrawn, cooling and solidification of the large molten pool of metal 16 occurs. However, there is a substantial temperature gradient between the outside and the center of the conical molten metal pool 16 so that on the outer periphery of the pool, freezing or solidification occurs more rapidly than within the interior. Due to its rapid solidification rate, the chemical composition near the surface of the ingot is essentially homogeneous and the same as that of the electrode; on the other hand, the near-equillibrium rate which occurs in the slowly cooled center of the ingot produce freezing segregation, i.e., the composition of the last metal to solidify is either richer or poorer in alloy content than the gross composition of the ingot. In addition, the slow cooling near the center results in very large grain size.

Now referring to FIG. 2 schematically illustrating the invention concept, a body of previously melted and solidified metal 18, e.g. titanium, is disposed in a water cooled cooper crucible 20 with an argon plasma torch 22, positioned above the upper surface of the titanium solid body 18.

Titanium chip scrap, indicated at 24, is fed onto the upper surface of the body 18, and is melted or fused by the plasma torch, to form a small shallow horizontally disposed pool of molten metal 26 on the upper surface of the metal body 18.

Now referring to FIG. 3, in practice, the crucible 20 of FIG. 2 cn be in the form of a mold car 28 on wheels 30, travelling on a track 38, to permit continuous horizontal back and forth translation of the the car 28, at a desired rate of speed.

During and after formation of the molten pool of metal 26, the mold car 28 is being moved at a slow controlled rate in the longitudinal direction indicated by the arrow 32 in FIG. 3. The rate of movement of the mold car is such that the rate of melting equals the rate of freezing and therefore the size of the small, shallow molten pool of metal 26 remains constant as the mold car carrying the solid body and chips 24, moves with respect to the fixed plasma torch 22, so that the plasma torch 22 is now directed onto an area adjacent to the previously formed molten pool 26. Thus, when the car 28 has moved sufficiently to the right, as indicated by arrow 32, the plasma torch 22 now indicated by dotted lines 22, is positioned above an area 34 of the upper surface of the metal body 18, which is adjacent to the molten pool 26. As such movement of the car occurs, the plasma torch imparts a local intense heat to the chips 24 and the surface 34 of the body, and extending the small molten pool of metal as now indicated by dotted lines at 26, while the initially formed molten pool 26 freezes rapidly. This rapid cooling precludes segregation during solidification and results in formation of fine grain, since very little time is available for grain growth. Uniformity of chemical composition and avoidance of segregation is ensured by use of a homogeneous starting stock, e.g. a homogensous blend or mixture of titanium scrap, master alloy and titanium sponge. Homogenization of the composition is further enhanced by the diffusion which takes place during melting.

Thus, it can be seen that as the mold car makes a complete horizontal pass or traverse beneath the plasma torch 22, there is a continuous, gradual integrated melting and freezing or solidification of a successive series of shallow pools 26 of molten metal, as the plasma torch 22 impinges on the chips 24 along the upper surface of the metal body 18 from one end of the mold car 28 to the other, in a single pass. If desired, multiple horizontal passes of the mold car 28 beneath the palsma torch 22 can be effected, the product of which may be visualized as a multiple pass weld bead or a weldment consisting of many small ingots welded together.

Since the resulting billet or slab is much more homogeneous than conventional ingots and uniformly fine grained, only a small amount of hot working is required for grain refinement and reduction to final configuration. Thus, in the case of titanium, all hot working may be performed below the beta transus, i.e., in the alpha-beta field. Hot working of billets or slabs produced according to the invention process, above the beta transus (required for conventional ingots in order to refine the large grains and thus minimize cracking during alpha-beta working) is unnecessary. This precludes the development of heavy alpha platelets at prior beta grain boundaries which occurs during slow cooling of large blooms through the beta transus zone. Thus, the possible occurrence of undersirable microstructural features in products which originate from such alpha platelets is completely avoided.

The improvements in homogeneity and microstructure lead to improvements in product properties. Thus, in thick products, anistropy will be reduced and degradation of mechanical properties at the center of the billet will be eliminated. Also, the need for considering raw stock thickness when determining response to heat treatment will be eliminated. The properties of thin products will be enhanced by their ultra fine grain size and reduced texturing. The enhancement of properties is not limited to mechanical properties such as strength, ducility, fracture toughness and crack propagation. It will also include formability and superplasticity.

The ability to employ scrap, such as titanium chips, in the invention process enhances the economics of the process, by the utilization of large amounts of almost valueless metal.

Figure 4:
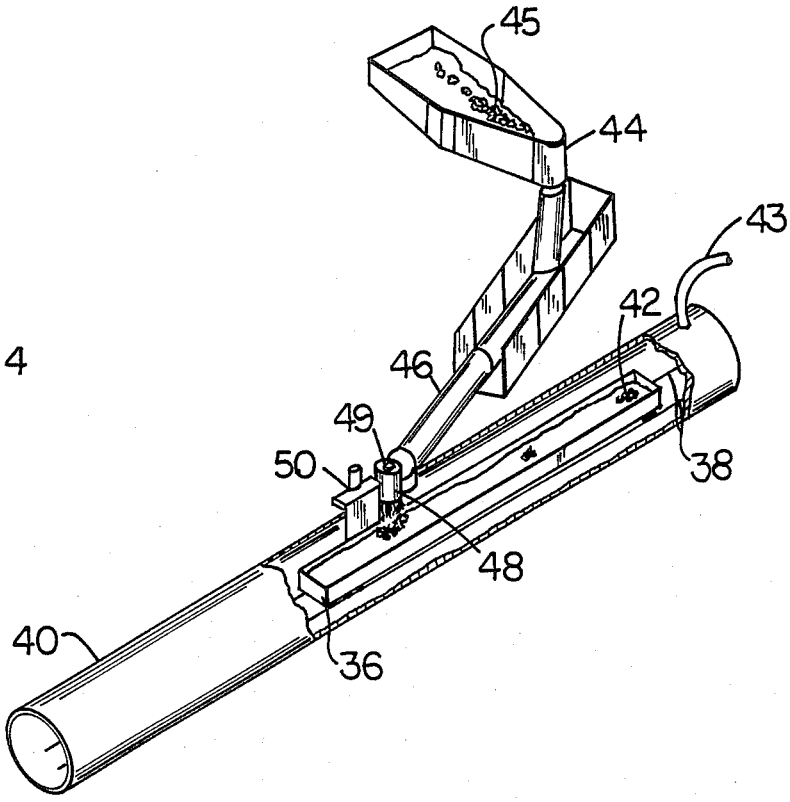
FIG. 4 is a perspective view of a system for feeding scrap metal onto a metal slab in a mold car which is continuously moved horizontally beneath a plasma torch in an argon filled chamber, to produce the travelling small molten pool of metal, illustrated in FIG. 3

Referring now to FIG. 4 of the drawing, illustrating a device for carrying out the procedure of the invention, a powered mold car 36 is mounted on a track 38 for horizontal reciprocal movement within a furnace 40. The mold car 36 is filled with a charge at 42 consisting of a homogeneous blend of titanium alloy chips, master alloy and titanium sponge, in the form of a mixture of about 85% chips, about 14% sponge and about 1% master alloy, by weight, and the car placed in the furnace chamber. An example of titanium alloy chips is 6A1-4V Ti, and the master alloy employed therewith can be an alloy consisting of 60% aluminum and 40% vanadium. The chamber is then sealed, evacuated and filled with argon.

A hopper 44 containing additional charge at 45 is provided for feeding through a charge chamber 46 to a charge station 50 within the sealed argon chamber 40, for discharge onto the surface of the previously melted solid metal in mold car 36. An argon plasma torch 48 is mounted, adjacent to the charge station 50, on a swivel joint at 49 to permit limited lateral motion of the torch.

The plasma torch 48 produces an intensely hot (about 19,000° F.) plasma which flows through the charge 42 in the mold car, melting it and forming a small shallow molten pool, directly below the plasma torch, as indicted at 26 in FIG. 3, on the solid metal 42. The argon discharged from the torch passes through the furnace 40 and is recovered. For example, a 600 KW plasma torch can be used. As the mold car moves at a controlled rate, the plasma torch 48 swivels from side-to-side to form the traveling molten pool of metal. The size of the molten pool of metal formed is controlled by the movement of the mold car 36 to be consistent during the melting sequence and is generally not more than about two inches deep and about twenty inches in diameter, typically about 15 inches in diameter and about an inch deep although it will be understood that the size of the small molten pool of metal formed can vary.

The mold car 36 is run back and forth under the plasma torch to produce an initial layer of slab or billet.

Thereafter, as many times as desired additional charge can be fed via charge station 50 onto the resulting solid and melted by the plasma torch 48 in the manner described above to form a billet or slab of the required thickness. Because of its homogeneity and fine grain, the product is suitable for forging or rolling without additional melting.

The plasma torch 48 is mounted to swivel from side-to-side a limited amount, in order to direct the heat at the charge along the sides of the mold car as well as at the center thereof. Also, if desired, the plasma torch 48 can be swivelled longitudinally, in the direction of travel of mold car 36. In addition, the plasma torch 48 can be raised and lowered to accommodate added thickness of the solid metal in the mold car.

Further, if desired, a sheet or layer of metal may be placed in the mold car initially before charging to ensure that the copper bottom of the mold car does not melt.

The employment of the novel melting procedure of the invention, which produces fine grained billets and slabs without segregation, particularly in conjunction with plasma melting, is particularly well suited for recovering or recycling light titanium scrap because the diffuse plasma heat source does not blow the scrap away, as is the case when employing an arc for melting.

A number of additional variations including the use of the process of the invention in conjunction or in combination with other technologies can be utilized. Thus, clad and other dissimilar multi-layer combinations can be made. Barrier layers can be included when necessary to prevent brittle interfaces. Metal fiber and ceramic reinforcements can be readily added to all or some of the layers.

The process of the invention is suitable for reactive metals such as titanium, zirconium and hafnium, which, when molten, dissolve refractory mold materials. Other metals which are susceptible to segregation and large grain problems such as 300M steel, Custom 455 and PH 13-8 Mo stainless steels, tool steels, and aluminum, nickel, cobalt and tantalum alloys also can be used in the invention process.

Billet width, length and thickness can be varied or tapered. The invention process is capable of producing billets having a multiplicity of sizes ranging from a wide thin slab to a heavy channel section or a heavy equiaxed billet. The billets produced by the invention process can be in simple shapes such as T, Y, cross, and L shapes, channels or U-shapes. Ultra fine grain material, for enhanced superplasticity or other purposes, can be produced by reducing the thickness of the layer, thereby increasing the solidification rate.

Argon chambers can be added for loading and cooling and multiple plasma torches can be employed. Gases other than argon, such as hydrogen, oxygen and nitrogen or mixed gases can be used in the furnace or added by mixing with the torch argon. Also argon recovery systems can be utilized.

Use of a plasma torch is preferred for chips since it does not blow the chips around. However, if desired, other suitable heat sources such as an electron arc or electron or laser beam can be employed.

The present invention is not limited to use of scrap or other fine raw material such as powder. The raw material can be a solid body or electrode, e.g. a solid titanium rod, as long as it is melted so as to form a small moving molten pool. Other materials can be blended with the starting stock, e.g. titanium scrap. The rapid solidification which occurs according to the invention process will permit production of products from some alloys not practical or feasible using conventional melting and casting techniques, for example, the titanium alooy Ti-12 Al.

The important benefits of the present invention are the chemical homogeneity and fine grain of the billet produced. The first is achieved by starting with a homogeneous raw material and use of a small, shallow molten pool which results in rapid freezing and thus precludes segregation during solidification. The second is solely a result of the near-instantaneous freezing of the molten metal so that very little time is available for grain growth. The concept is rendered economically viable, i.e., capable of a normal production rate, by the translation motion of the heat source and the molten pool, with respect to the solidified metal, to form a horizontal billet.

Although the present invention has been described with respect to specific details of certain embodiments thereof, and since various changes and modifications of the invention will occur to and can be made readily by those skilled in the art without departing from the invention concept, the invention is not to be taken as limited except by the scope of the appended claims.

What is claimed is:

1. The process for producing a metal billet or slab which is substantially homogeneous, fine grained and free of freezing segregation, which comprises fusing said metal by an intense local heat source in the form of a plasma torch to provide a localized shallow molten pool of metal within a mold and traversing said mold substantially horizontally with respect to said heat source, at a controlled rate while maintaining said localized molten pool of metal within said mold adjacent to said local heat source, the rate of traverse being such that the rate of melting equals the rate of freezing and the size of said molten pool remains substantially constant, whereby freezing of said localized molten pool of metal occurs rapidly as the mold traverses with respect to said heat source.

2. The process for producing a metal billet or slab which is substantially homogeneous, fine grained and free of freezing segregation, which comprises fusing said metal by an intense heat source in the form of a plasma torch to provide a small shallow molten pool of metal within a charge of said metal, and traversing said charge of metal with respect to said heat source, at a controlled rate thereby causing said small molten pool of metal to also traverse within said metal charge, continually melting fresh charge metal adjacent to its leading edge and causing rapid freezing of the metal adjacent to the trailing edge of said small molten pool of metal as the melted charge moves away from the heat source, the rate of traverse being such that the rate of melting equals the rate of freezing and the size of said molten pool remains substantially constant.

3. The process of claim 2, said process being carried out in an inert atmosphere.

4. The process of claim 3, said inert atmosphere being argon.

5. The process of claim 2, wherein said metal is scrap metal.

6. The process of claim 2, wherein said metal is a mixture of scrap metal, master alloy and virgin metal.

7. The process of claim 2, wherein said metal charge is a solid titanium body.

8. The process of claim 2, wherein said metal charge is scrap titanium.

9. The process of claim 2, wherein said metal charge is a mixture of titanium alloy scrap and titanium sponge.

10. The process of claim 2, wherein said metal charge is a homogeneous mixture of titanium alloy scrap, master alloy and titanium sponge.

11. The process of claim 2, comprising continuously traversing said metal charge in a substantially horizontal plane under said heat source.

12. The process of claim 11, including traversing said metal charge for several passes under said heat source.

13. The process of claim 2, including moving said heat source in relation to said metal charge during traverse of said metal charge.

14. The process for producing a billet or slab of a metal which is susceptible to segregation and formation of large grains when subjected to fusion followed by slow freezing, which comprises translating a charge of metal in a substantially horizontal plane at a controlled rate under a plasma torch and forming a shallow travelling molten pool of metal of substantially constant size in said charge of metal directly beneath said plasma torch, the rate of movement of said molten pool of metal under said plasma torch permitting rapid freezing of said pool of metal as the plasma torch is directed at successive areas of the charge, the body of solidified metal formed from said pool of metal being substantially homogeneous, fine grained and free of chemical segregation.

15. The process of claim 14, wherein said charge of metal is scrap metal.

16. The process of claim 14, wherein said charge of metal is a previously solidified body, and including feeding scrap metal onto the upper surface of said solid body of metal, and impinging the plasma from said plasma torch on said scrap metal to form said molten pool of metal beneath said torch.

17. The process of claim 14, wherein said charge of metal is titanium scrap.

18. The process of claim 16, wherein said solid body of metal is titanium, and wherein said scrap metal is titanium scrap.

19. The process of claim 14, wherein said charge of metal is a homogeneous mixture of titanium alloy scrap and titanium sponge.

20. The process of claim 14, wherein said charge of metal is a homogeneous mixture of titanium alloy scrap, master alloy and titanium sponge.

21. The process for producing a titanium billet or slab from titanium scrap, which comprises placing titanium scrap in a moveable mold car, moving said mold car continuously longitudinally in a substantially horizontal plane under a plasma torch at a rate which is controlled to produce a small, shallow, travelling molten pool of metal of substantially constant size in the charge of said scrap directly beneath said plasma torch, the rate of movement of said mold car under said plasma torch permitting rapid solidification at the trailing edge of said molten pool of metal as the mold car moves with respect to said plasma torch, the body of solidified titanium formed from said pool of metal being substantially homogeneous, fine grained and free of chemical segregation.

22. The process of claim 21, including moving said mold car for several passes under said plasma torch.

23. The process of claim 21, including feeding additional titanium scrap onto the surface of the solidified body of titanium, and continuing to move said mold car under said plasma torch as aforesaid to weld additional solid titanium onto said solidified body of titanium.

24. The process of claim 21, including moving said plasma torch from side-to-side during longitudinal movement of said mold car.

25. The process of claim 21, said mold car and said plasma torch being positioned in a zone containing an inert atmosphere.

26. The process of claim 25, said plasma torch being an argon plasma torch, and said inert atmosphere being argon.

* * * * *

UNITED STATES PATENT AND TRADEMARK OFFICE

CERTIFICATE OF CORRECTION

PATENT NO. : 4,794,979

DATED : January 3, 1989

INVENTOR(S) : ROBERT H. GASSNER, et al

It is certified that error appears in the above-identified patent and that said Letters Patent is hereby corrected as shown below:

Front page, left column, Code (73), the Assignee "McDonnell Douglas Corporation, Long Beach, Calif." should be changed to --McDonnell Douglas Corporation, Long Beach, Calif., a part interest--.

Signed and Sealed this

Fifteenth Day of August, 1989

*Attest:*

*Attesting Officer*

DONALD J. QUIGG

*Commissioner of Patents and Trademarks*